US007559753B2

(12) United States Patent
Burrage

(10) Patent No.: US 7,559,753 B2
(45) Date of Patent: Jul. 14, 2009

(54) DOUBLE DISC PUMP WITH FIXED HOUSING BLOCK

(75) Inventor: Leslie J. Burrage, Doylestown, PA (US)

(73) Assignee: Penn Valley Pump Company, Inc., Warrington, PA (US)

( * ) Notice: Subject to any disclaimer, the term of this patent is extended or adjusted under 35 U.S.C. 154(b) by 845 days.

(21) Appl. No.: 10/949,345

(22) Filed: Sep. 27, 2004

(65) Prior Publication Data

US 2006/0073025 A1 Apr. 6, 2006

(51) Int. Cl.
*F04B 11/00* (2006.01)

(52) U.S. Cl. ..... 417/539; 417/360; 417/900; 417/510; 417/515; 417/520

(58) Field of Classification Search ..... 417/240, 417/241, 479, 510, 515, 520, 539, 900, 360, 417/423.14; 415/126
See application file for complete search history.

(56) References Cited

U.S. PATENT DOCUMENTS 1,465,032 A * 8/1923 Wickwire et al. ..... 417/398
3,424,096 A 1/1969 Hughes
3,998,130 A * 12/1976 Hirmann ..... 91/59
4,211,519 A * 7/1980 Hogan ..... 417/360
4,473,339 A * 9/1984 Hughes ..... 417/479
5,344,291 A * 9/1994 Antkowiak ..... 417/359
5,690,478 A * 11/1997 Zollner ..... 417/533
6,315,532 B1 * 11/2001 Appleby ..... 417/510
6,461,115 B1 * 10/2002 Ferrier et al. ..... 417/53
7,074,017 B2 * 7/2006 Coray et al. ..... 417/360

FOREIGN PATENT DOCUMENTS

GB 2013287 * 8/1979
GB 2013287 A 8/1979

* cited by examiner

*Primary Examiner*—Devon C Kramer
*Assistant Examiner*—Amene S Bayou
(74) *Attorney, Agent, or Firm*—Gregory J. Gore

(57) ABSTRACT

A double disc pump includes a stationary main pump housing block that can remain fixed to its supporting frame while all other parts of the pump are removed for servicing. This permits disassembly of the pump without disconnecting the inlet or outlet plumbing and is provided by a pump housing which is vertically divided along parallel horizontal planes into housing segments. An intermediate housing segment is hingedly mounted to the main block segment. A bottom housing segment is hingedly mounted to the intermediate housing segment. These three segments capture all of the internal parts of the pump including the suction and discharge discs and the trunnion seals. The hinged design of the segments allows them to conveniently swing away from other parts of the housing so that access to the internal structures can be accomplished without completely removing each segment.

4 Claims, 6 Drawing Sheets

DOUBLE DISC PUMP WITH FIXED HOUSING BLOCK

FIELD OF THE INVENTION

This invention relates to liquid pumps of the double disc type which have coordinated reciprocating suction and discharge discs that seal against seat areas of the pump housing. More specifically, it relates to the housing design of such pumps.

BACKGROUND OF THE INVENTION

Double disc pumps are well-known, particularly those suited for feeding and transferring sludges and slurries. This type of pump utilizes a unique principle of operation where the discs perform the duties of both diaphragm and valve providing a double acting, non-clogging pump action. Through an arrangement of connecting rods and a crank shaft, the reciprocating action of the discs is created forming a large cavity between the discs. This cavity is filled and exhausted in a continuous flow. The valve-like discs have large seating areas that provide for low internal velocities extending the pump wear life when handling sludges and slurries. The fluid chamber is sealed with flexible trunnions which eliminates packings and mechanical seals and requires no flushing water or other forms of lubrication. Most typically, the pumps are horizontally mounted on a support frame and connected to inlet and discharge conduits.

The construction of this type of pump is shown for example in United Kingdom Patent Application GB 2,013,287. It includes a drive mechanism mounted from the top of the pump housing which includes vertically reciprocating discs that operate upon a working fluid. The drive mechanism includes a drive shaft that turns eccentrics which reciprocally drives connecting rods. At the ends of the connecting rods are discs which provide the valving and pumping action. The pump housing is divided into three segments which are separated on horizontal planes. Pumps of this type are suspended from framework which is affixed to the middle or intermediate segment. It will be understood from this prior art pump that in order to obtain access to both discs the entire pump assembly including drive shaft connecting rods and all housing segments must be completely disassembled. Furthermore, both the intake and discharge plumbing need to be disconnected. This is a serious problem because it creates a substantial amount of costly downtime and maintenance expense. There is therefore a need in the art for a double disc sludge pump design which provides ease of disassembly to reduce maintenance costs.

SUMMARY OF THE INVENTION

In order to meet the needs in the art described above, the present segmented pump housing design has been devised. According to this new design, a stationary main pump housing block which includes the discharge port is mounted directly to the support frame and two segmented housing portions are individually attached beneath the main block. With this arrangement the main block can remain stationary in the mounting frame and connected to the discharge plumbing while all other parts are removed from it. The portion of the housing below the main block contains the discs and their seating areas which can be inspected, removed, and replaced from the bottom of the pump once internal access is obtained. Prior art pump housings include a removable bottom plate which divides the lower portion of the housing along a horizontal plane just above the seating area of the suction disc but below the seat area of the discharge disc. However, as explained above, while these housings provide maintenance access to the suction disc, the discharge disc cannot be accessed or replaced without disassembling the entire pump. The new configuration provides a main block of the pump housing body which can remain stationary and fixed to the support frame and discharge connection while all other parts of the pump assembly are removed. Therefore, both discs can be easily accessed and maintained. Furthermore, a unique hinge design of the segments allows them to conveniently swing away from the rest of the housing so that access to the internal structures can be accomplished without completely removing each segment.

More specifically, the applicant has invented a double disc pump for propelling working fluid from an inlet conduit to an outlet conduit, comprising a mounting frame, a pump housing vertically divided along parallel horizontal planes into housing segments, a stationary main block housing segment mounted directly to the support frame and including an outlet conduit, and an intermediate housing segment hingedly affixed and mounted to the main block. Mounting lugs on the main block are bolted to longitudinal members of the frame for securement. The intermediate housing segment includes a discharge disc seat and a suction seal. A bottom housing segment is hingedly affixed and mounted to the intermediate housing segment, the bottom housing segment including a suction disc seat and an inlet conduit whereby the bottom housing segment and the intermediate housing segment may be removed to provide full access to the discharge disc and the suction disc without removing the main block segment from the frame and the outlet conduit. The pump further includes an inlet elbow affixed to and upstream of the inlet conduit, the elbow having a vertically disposed intake opening connected to inlet plumbing at a horizontal joint.

Other objects and advantages of the invention will become apparent to those of skill in the art from the following drawings and description of the preferred embodiment.

DESCRIPTION OF THE PREFERRED EMBODIMENT

Figure 1:
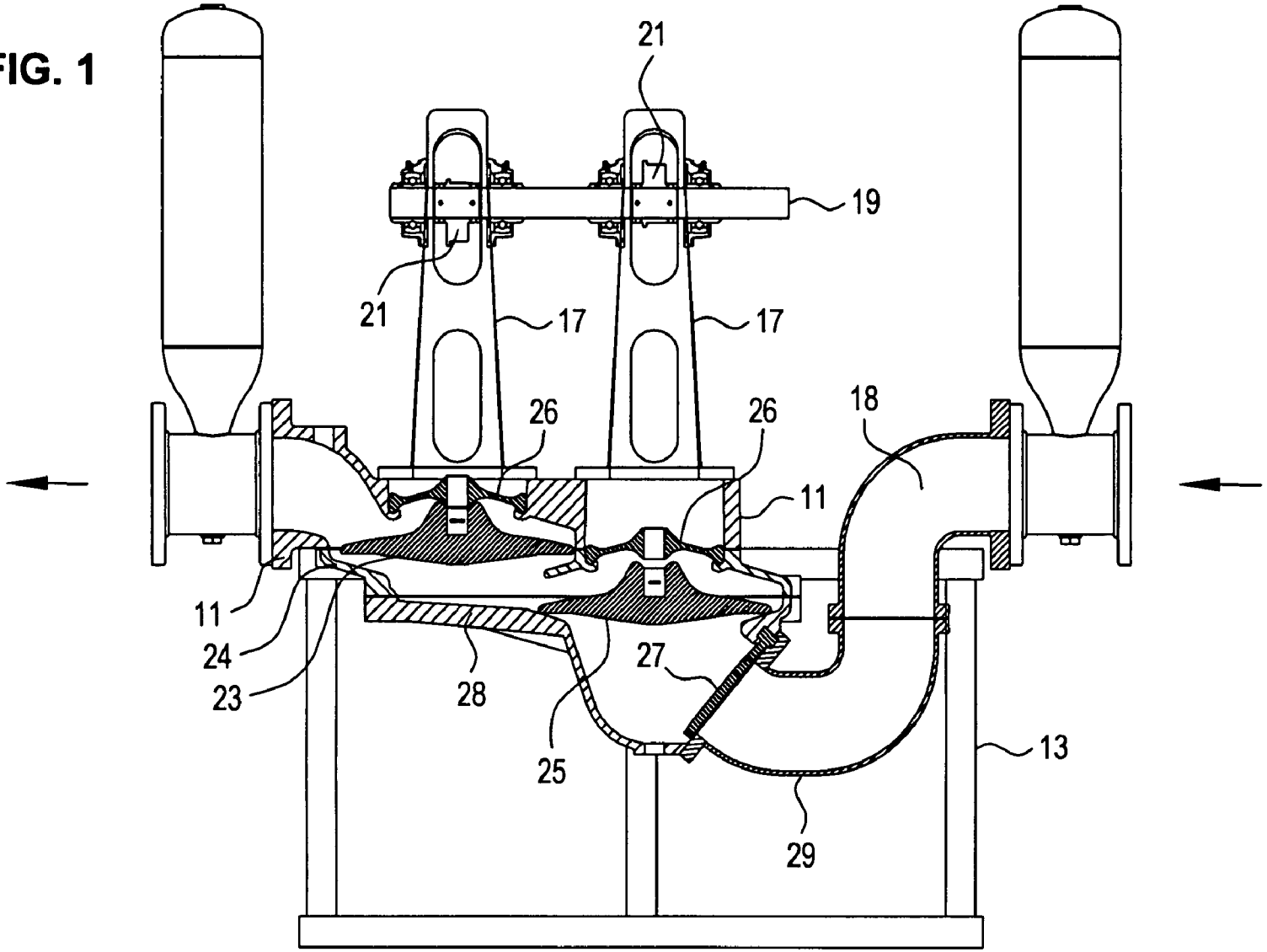
FIGS. 1-4 are left side elevation sectional views of the present invention showing the disassembly sequence.
Figure 5:
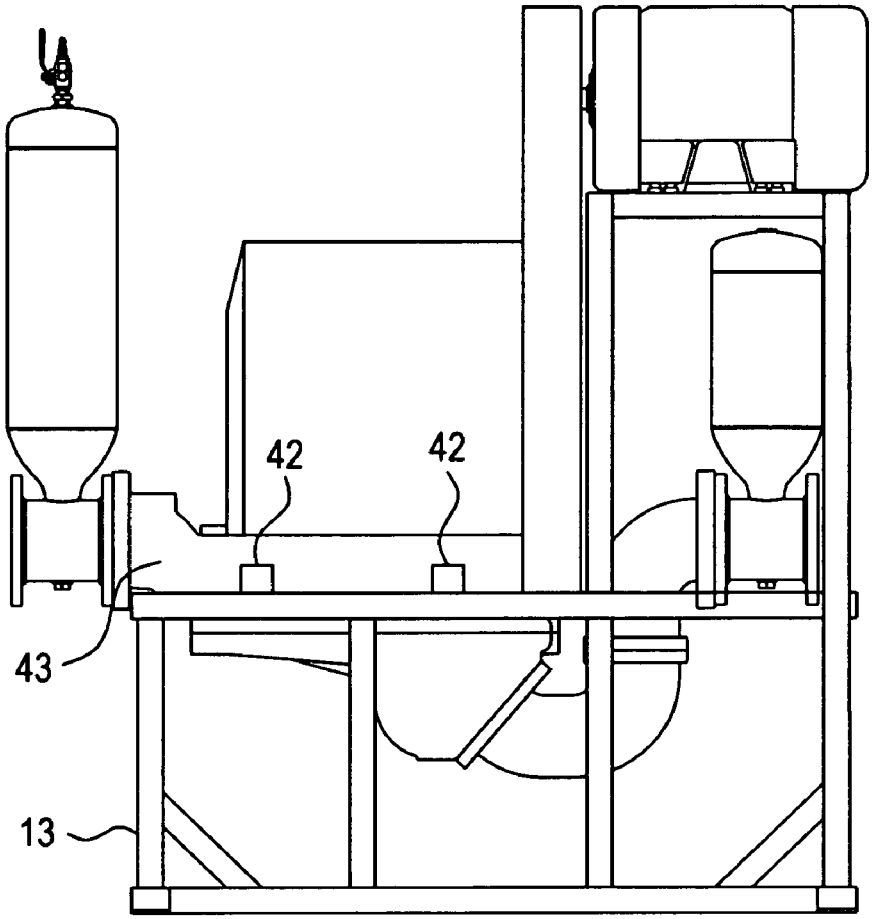
FIG. 5 is a left side elevation view.
Figure 6:
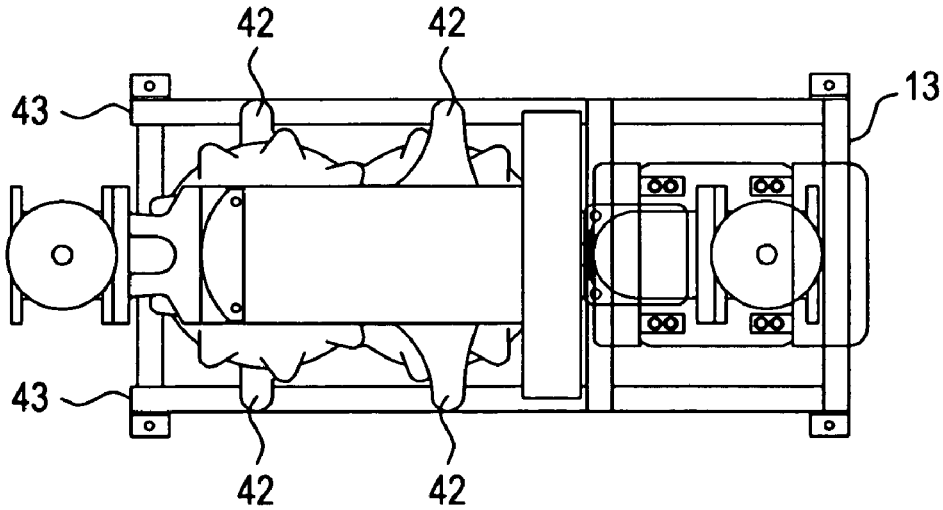
FIG. 6 is a top plan view.

Referring now to FIG. 1, a double disc pump of the present invention is shown. Fluid flows through the pump from right to left as shown by the direction arrows. The pump comprises a main housing block 11 which is mounted to support framework 13, greater detail of which is depicted in FIGS. 5 and 6. The main housing block supports drive shaft pedestals 17 which include bearings that rotatably support drive shaft 19. The drive shaft has eccentrics 21 that move connecting rods (not shown) which are connected at their bottoms to disc valves 23 and 25. Flexible seals 26 are mounted to the connecting rods and seal the housing fluid chamber. Mounted to the bottom of the main block is intermediate housing segment 24. As shown in this figure, this segment has top and bottom surfaces which lie along horizontal planes. This intermediate housing segment includes the suction disc seal and the discharge disc seat. Affixed to the bottom of the intermediate housing segment is bottom segment 28 that includes the suction disc seat and flap valve 27. Elbow 29 connects the inlet line 18 with the pump intake port which lies adjacent the flap valve 27. Each segment is affixed one to another by a series of bolts (not shown) positioned around the outer edges of each segment.

Figure 2:
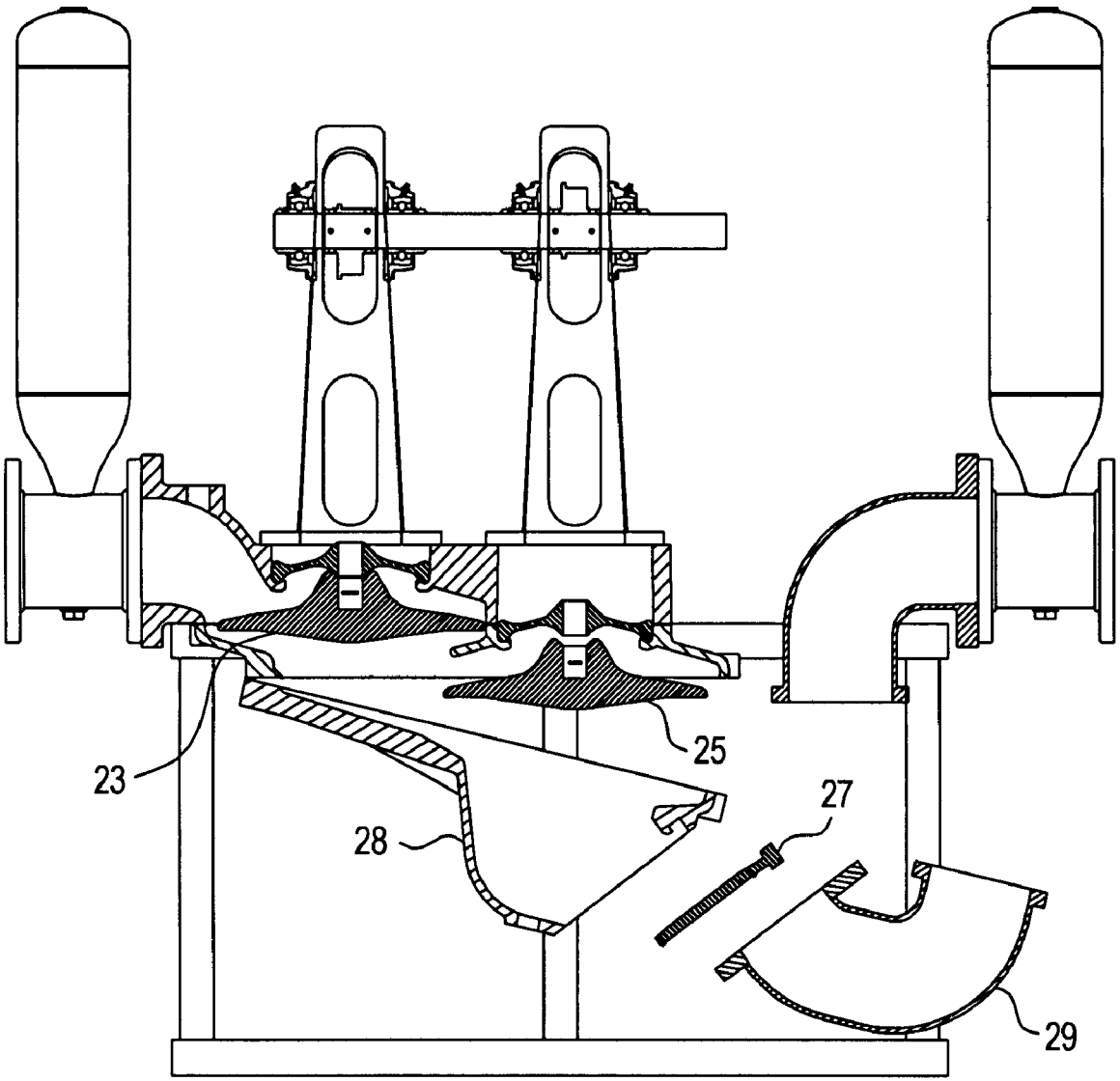
Figure 7:
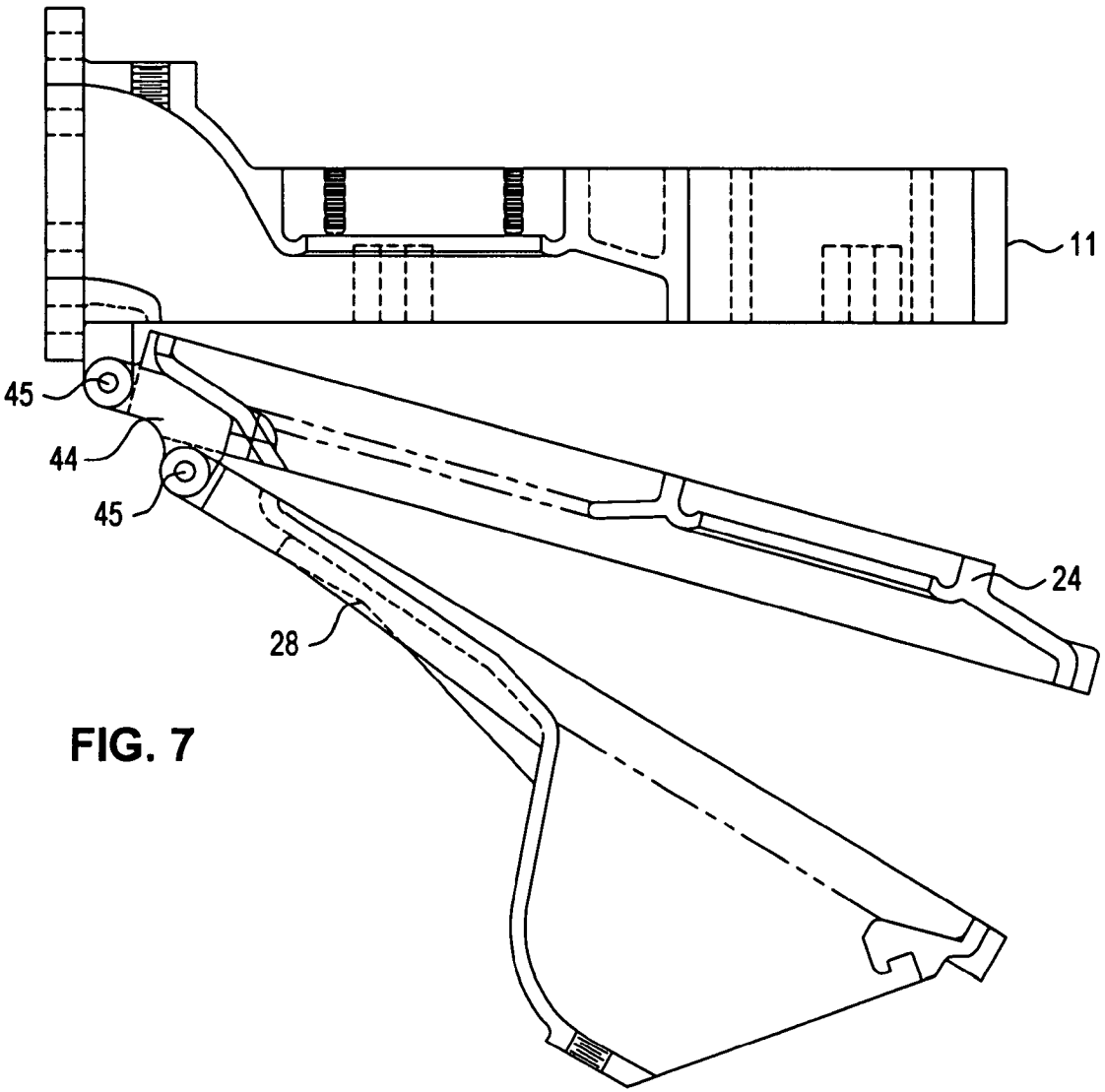
FIG. 7 is a side sectional view of the hingedly interconnected pump housing segments.

Referring now to FIG. 2, disassembly of the bottom housing segment 28, flap valve 27, and elbow 29 is depicted. It can be seen from this figure that by opening the bottom segment the access to the suction disc 25 is provided as well as all interior parts of the housing around it. Also accessible for inspection at this point of disassembly is discharge disc 23. As shown in this drawing, the bottom segment 28 is hingedly connected to the front of the intermediate segment. Greater detail of the hinge joints are shown in FIG. 7.

Figure 3:
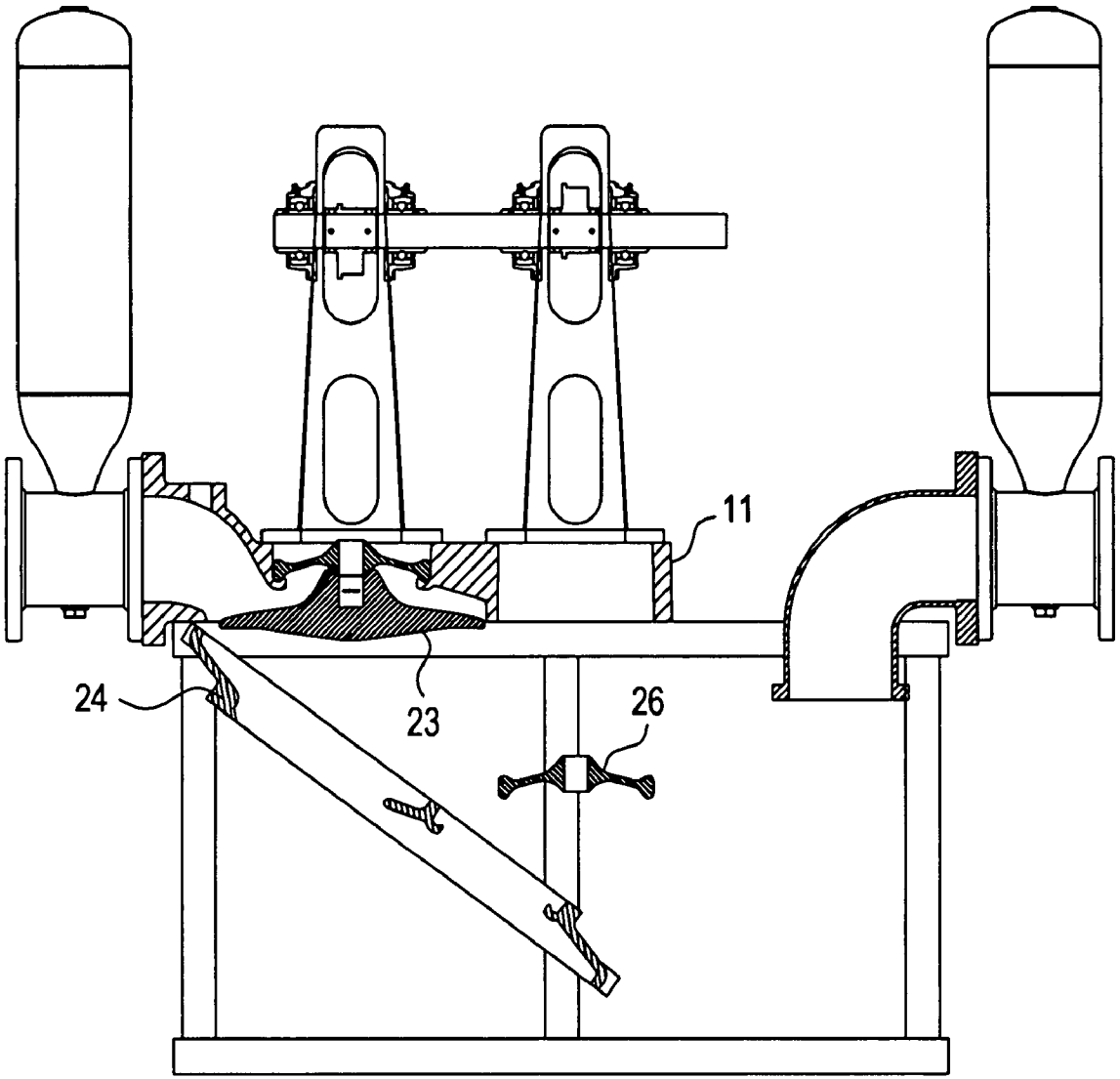

Referring now to FIG. 3, with the bottom housing segment removed the intermediate segment 24 may now be loosened and pivoted away from the main block 11. As shown in this figure, this provides access to the suction seal 26 for replacement and removal and also direct access to the discharge disc 23. Like the bottom segment, the intermediate housing segment is hingedly supported along a front side of main block 11.

Figure 4:
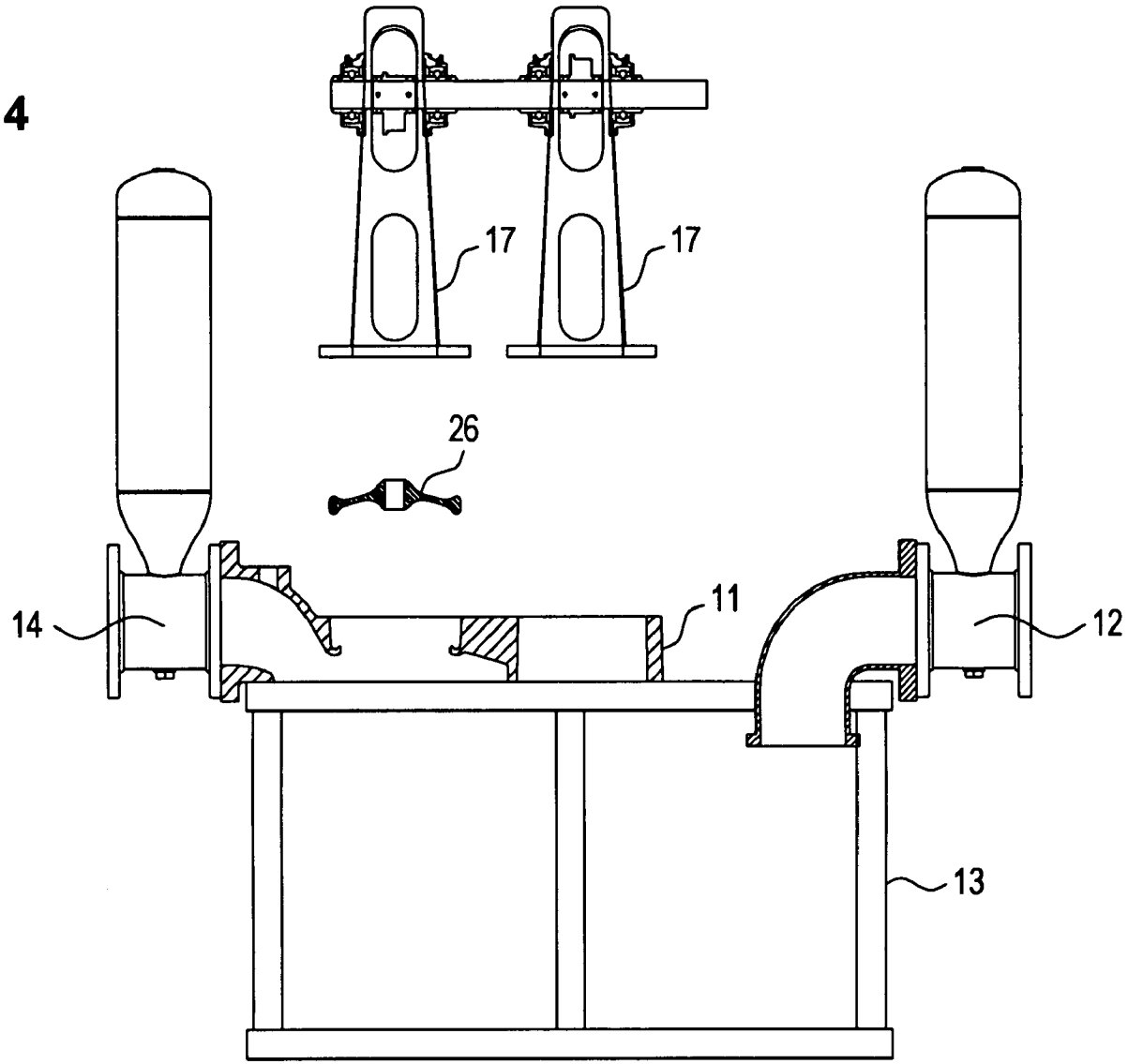

Referring now to FIG. 4, with the main block 11 remaining affixed to the support frame 13 and discharge plumbing 14, the remaining elements of the pump assembly, namely the drive components comprising discharge seal 26, drive shaft pedestals 17, the drive shaft and the connecting rods, can be removed. Thus, complete and full access to all parts of the pump assembly can be accessed, disassembled, and repaired without disturbing the inlet plumbing 12, the main block 11, or the discharge plumbing 14. This provides a great advantage over the prior art which affords ease of maintenance that reduces maintenance costs and downtime.

FIGS. 5 and 6 show the frame mounting of the invention which enables disassembly of the pump while the main block remains secured to the mounting frame and the discharge plumbing as shown in FIGS. 1-4. Referring now to FIG. 5, the side view shows the mounting lugs 42, which are a part of the main block casting, resting upon longitudinal support frame members 43 of frame 13. The mounting lugs 42 are securely bolted to frame member 43 by using the usual bolts (not shown in this figure). Referring now to FIG. 6, a top view also shows the relationship between the side mounting lugs 42 of the main block and the longitudinal support frame members 43.

Referring now to FIG. 7, the three pump housing segments are shown hingedly interconnected by hinge coupling mechanism 44. The hinge joints are simple, pinned, knife-and-fork hinge joints, both of which are mounted to the intermediate housing segment 24. The axis of rotation of each joint, i.e. the location of the hinge pins 45, allows the intermediate segment 24 and the bottom segment 28 to swing downward away from the main block 11. This greatly facilitates ease of maintenance. The particular hinge mechanism shown may be substituted by any mechanical means known in the art for creating a suitable hinge joint which operates as desired. The details of this hinge mechanism in themselves form no part of the present invention.

It should be understood that there may be other modifications and changes to the present invention that will be obvious to those of skill in the art from the foregoing description, however, the present invention should be limited only by the following claims and their legal equivalents.

What is claimed is:

1. A double disc pump for propelling working fluid from inlet plumbing to discharge plumbing, comprising:

a framework supporting a pump from below and inlet plumbing in fluid communication with said pump, said inlet plumbing being independently supported by the framework and said pump being supported on said framework only by affixation of a stationary main block segment of said pump;

a pump housing vertically divided along parallel horizontal planes into housing segments;

the stationary main block housing segment mounted directly to said support framework and including two reciprocally supported discs, a suction disc and a discharge disc, and further including discharge plumbing;

an intermediate housing segment mounted to said main block, said intermediate housing segment including a discharge disc seat and a suction seal;

a bottom housing segment mounted to said intermediate housing segment, said bottom housing segment including a suction disc seat and being in fluid communication with the inlet plumbing whereby said bottom housing segment and said intermediate housing segment may be removed to provide full access to the discharge disc and the suction disc without removing said main block segment or said inlet plumbing from said framework; and wherein said bottom housing segment is hingedly affixed to said intermediate housing segment and said intermediate housing segment is hingedly affixed to said stationary main block housing segment.

2. The double disc pump of claim 1 further including an inlet elbow removably affixed between said inlet plumbing and the pump.

3. The double disc pump of claim 1 further including mounting lugs on said main block for securement of said stationary main block to said framework.

4. The double disc pump of claim 3 wherein said mounting lugs are bolted to longitudinal members of said framework.

* * * * *